US005614036A

United States Patent [19]

Imahashi et al.

[11] Patent Number: 5,614,036

[45] Date of Patent: Mar. 25, 1997

[54] HIGH HEAT RESISTING AND HIGH ABRASION RESISTING ALUMINUM ALLOY

[75] Inventors: Kunihiko Imahashi, Aichi-ken; Hirohisa Miura, Okazaki; Yasuhiro Yamada, Tajimi; Hirofumi Michioka, Toyota; Jun Kusui; Akiei Tanaka, both of Ohmihachiman, all of Japan

[73] Assignees: Toyota Jidosha Kabushiki Kaisha; Toyo Aluminium Kabushiki Kaisha, both of Japan

[21] Appl. No.: 594,331

[22] Filed: Jan. 30, 1996

Related U.S. Application Data

[63] Continuation of Ser. No. 160,724, Dec. 2, 1993, abandoned.

[30] Foreign Application Priority Data

Dec. 3, 1992 [JP] Japan ..... 4-324030
Dec. 25, 1992 [JP] Japan ..... 4-346739

[51] Int. Cl.[6] ..... C22C 21/00; C22C 1/10

[52] U.S. Cl. ..... 148/437; 148/438; 148/439; 148/440; 420/548; 420/550; 420/551; 75/230; 75/244; 75/249

[58] Field of Search ..... 148/437, 438, 148/439, 440; 420/548, 549, 550, 551, 529, 535, 544; 75/230, 244, 249

[56] References Cited

U.S. PATENT DOCUMENTS

| | | | |
|---|---|---|---|
| 3,885,959 | 5/1975 | Badia et al. | 75/138 |
| 4,702,885 | 10/1987 | Odani et al. | 419/23 |
| 4,722,751 | 2/1988 | Akechi et al. | 75/232 |
| 4,946,500 | 8/1990 | Zedalis et al. | 75/232 |
| 4,975,243 | 12/1990 | Scott et al. | 420/534 |
| 5,279,642 | 1/1994 | Ohtera | 148/403 |

FOREIGN PATENT DOCUMENTS

| | | |
|---|---|---|
| 0100470 | 2/1984 | European Pat. Off. . |
| 0147769 | 7/1985 | European Pat. Off. . |
| 0196984 | 10/1986 | European Pat. Off. . |
| 0196369 | 10/1986 | European Pat. Off. . |
| 0363225 | 4/1990 | European Pat. Off. . |
| 0366134 | 5/1990 | European Pat. Off. . |
| 0539172 | 4/1993 | European Pat. Off. . |
| 0561204A2 | 9/1993 | European Pat. Off. . |
| 59-13040 | 1/1984 | Japan . |
| 59-59855 | 4/1984 | Japan . |
| 60-50138 | 3/1985 | Japan . |
| 63-247334 | 10/1988 | Japan . |
| 64-83637 | 3/1989 | Japan . |
| 1-83637 | 3/1989 | Japan . |
| 64-56844 | 3/1989 | Japan . |
| 1-272741 | 10/1989 | Japan . |
| 2-129338 | 5/1990 | Japan . |

(List continued on next page.)

OTHER PUBLICATIONS

Aluminum Alloy Metallurgy Symposium (preliminary typescript pamphlet) pp. 58 and 70.

Chemical Abstracts, vol. 113, 1990, p. 296 and JP–A–263 244, 19 Oct. 1989.

(2) European Search Reports dated Oct. 7, 1993. List of Prior Art Documents (3 pages).

*Primary Examiner*—Sikyin Ip

*Attorney, Agent, or Firm*—Finnegan, Henderson, Farabow, Garrett & Dunner, L.L.P.

[57] ABSTRACT

A high heat resisting and high abrasion resisting aluminum alloy and aluminum alloy powder have superior toughness, abrasion resistance, high temperature strength, and creep resistance and are useful to form engine parts for automobiles, airplanes, etc. The high heat resisting and high abrasion resisting aluminum alloy comprises 2 to 15 wt % of Ni, 0.2 to 15 wt % of Si, 0.6 to 8.0 wt % of Fe, one or two of 0.6 to 5.0 wt % of Cu and 0.5 to 3 wt % of Mg, the total amount of Cu and Mg being equal to or less than 6 wt %, one or two of 0.3 to 3 wt % of Zr and 0.3 to 3 wt % of Mo, the total amount of Zr and Mo being equal to or less than 4 wt %, 0.05 to 10 wt % of B, and the balance of Al and unavoidable impurities, and is produced by powder metallurgy.

5 Claims, 1 Drawing Sheet

FOREIGN PATENT DOCUMENTS

| | | |
|---|---|---|
| 2-149629 | 6/1990 | Japan . |
| 2-149631 | 6/1990 | Japan . |
| 2-149632 | 6/1990 | Japan . |
| 2-149633 | 6/1990 | Japan . |
| 2-56401 | 11/1990 | Japan . |
| 3-291348 | 12/1991 | Japan . |
| 4-105787 | 4/1992 | Japan . |
| 4-173935 | 6/1992 | Japan . |
| 4-176836 | 6/1992 | Japan . |
| 4-202736 | 7/1992 | Japan . |
| 4-202737 | 7/1992 | Japan . |
| 4-323343 | 11/1992 | Japan . |
| 4-311545 | 11/1992 | Japan . |
| 5-5147 | 1/1993 | Japan . |
| 5-5146 | 1/1993 | Japan . |

HIGH HEAT RESISTING AND HIGH ABRASION RESISTING ALUMINUM ALLOY

This application is a continuation, of application Ser. No. 08/160,724, filed Dec. 2, 1993, now abandoned.

BACKGROUND OF THE INVENTION

1. Field of the Invention

This invention relates to a high heat resisting and high abrasion resisting aluminum alloy and aluminum alloy powder having superior toughness, abrasion resistance, high temperature strength, and creep resistance, which are useful to form engine parts such as valve spring retainers, intake valves, and pistons, etc. for automobiles, air planes, and the like.

2. The Prior Art

Owing to the light weight and superior processability, aluminum alloys have been used as structural members for airplanes and automobiles from old times. Particularly, Al-Cu-Mg alloys such as JIS 2024, 2018 according to Japanese Industrial Standards are known as heat resisting alloys.

An Al-Ni alloy including 5% by weight (hereinafter % means % by weight) of nickel has been proposed in pages 58 and 70 of the preliminary typescript pamphlet of the aluminum alloy powder metallurgy symposium held by the Light Metal Institute on Mar. 9, 1987. Japanese Unexamined Patent Publication (KOKAI) Nos. 149629/1990, 149631/1990, 149632/1990, and 149633/1990 disclose 'Low Thermal Expansion Aluminum Alloys Having Superior Abrasion Resistance and Heat Conductivity' formed of Al-Ni-Si-Cu-Mg alloys including 8% or more of nickel and produced by casting.

Further, Japanese Examined Patent Publication (KOUKOKU) No. 56401/1990 discloses 'High Heat Resisting, High Abrasion Resisting and High Tensile Aluminum Alloy Powder' formed of Al-Ni-Si alloy powder including 7.7 to 15% of nickel and 15 to 25 % of silicon and having a primary Si size of 15 microns or less.

Aluminum alloys often cause seizing as compared to steels, when in slidable contact with an aluminum alloy or steel. On purpose to improve the sliding characteristics, Japanese Unexamined Patent Publication (KOKAI) No. 88819/1979 discloses a cast aluminum alloy including 0.4 to 5.5% of boron, and Japanese Unexamined Patent Publication (KOKAI) No. 247334/1988 discloses a cast aluminum alloy including 0.5 to 10% of boron. Further, a refined cast aluminum alloy including titanium and about 0.05% of boron is also known.

An automotive engine is always required of high power and a light weight. Accordingly, materials of engine parts must have a tensile strength of 500 MPa or more at room temperature, and 160 MPa or more at 300° C. It is preferable that the materials have a tensile strength of 200 MPa or more at 300° C. It is also demanded that the materials cause no seizing and no fretting fatigue phenomenon when in slidable contact with metals such as steel component parts.

Seizure is a phenomenon showing a sliding characteristic of a sliding metal member, namely, a phenomenon that, when a sliding member repeatedly moves over a mating metal member under a high load, the friction generates excessive heat so that a portion of the sliding member is fused and adheres to the mating member, the friction coefficients of the both members drastically increase, and the sliding member is fixed to the other member. A Fretting fatigue phenomenon is also a phenomenon showing a sliding characteristic of a sliding metal member, namely a phenomenon that, when a sliding metal member repeatedly moves over a mating member under a high load even under a sufficient oil lubrication, a portion of the sliding member adheres to the mating member and a fatigue failure occurs from the adhered portion.

In the above views, the Al-Cu-Mg alloys such as above JIS2024, JIS2018 have a superior tensile strength at room temperature but a low tensile strength of 300 MPa at a high temperature of 200° C., and a low tensile strength of 150 MPa at a high temperature of 300° C. Therefore, these Al-Cu-Mg alloys cannot be used for engine parts of modern automobiles and the like. The above Al-Ni alloys and Al-Ni-Si-Cu-Mg alloys have improved heat resistance and abrasion resistance owing to the intermetallic compound $NiAl_3$ generated in the tissue. However, because products are made by casting, the particle diameter of the intermetallic compound in the products become larger, and as a result, the tensile strength is only 380 MPa at room temperature and as low as 160 MPa at a high temperature of 300° C. Therefore, even these alloys are difficult to be used for engine parts of modern automobiles and the like.

On the other hand, the above Al-Ni-Si alloy powder is made into products by sintering. Namely, a raw material alloy of a certain composition is melt and atomized, thereby producing the above Al-Ni-Si alloy powder, and then the Al-Ni-Si alloy powder is made into products by cold preforming, extruding, and forging. Therefore, in the Al-Ni-Si alloy powder the intermetallic compound $NiAl_3$ has a particle diameter of about several microns or less, and the abrasion resistance is superior and the tensile strength is 510 MPa at room temperature and 345 MPa at 250 ° C. Sometimes, however, the Al-Ni-Si alloy cannot have a sufficient extruding ratio (a ratio of cross sections of the material before and after extruding) in producing engine parts of automobiles and the like.

Further, the cast aluminum alloy of Japanese Unexamined Patent Publication (KOKAI) No. 88819/1979 do not exhibit sufficient sliding characteristics, as it is assumed that boron does not exist as a simple substance. Namely, in a casting method, the amount of boron solid solved in the matrix of an aluminum alloy is small. Boron hardly dissolves at room temperature, and when gradually cooled, most of the boron dissolved in the molten metal varies into boron compounds such as $AlB_{12}$. It is supposed that these facts prevent the cast aluminum alloy from exhibiting sufficient sliding characteristics.

Further, MMC (metal matrix composites) in which ceramic particles or fibers are dispersed generally have a high strength at elevated temperatures, but a low forgeability and a low elogation. When we aim to improve the forgeability of aluminum alloys, high temperature strength decreases instead. Therefore, an optimum matrix must be selected for an aluminum alloy in order to have both a high strength at elevated temperatures and a superior forgeability.

SUMMARY OF THE INVENTION

The present invention has been conceived in view of the above circumstances, and it is an object of the present invention to provide an aluminum alloy and aluminum alloy powder which can be made into products having a superior forgeability, stable abrasion resistance, and superior tensile and yield strength especially at elevated temperatures.

The inventors of the present invention have found that superior heat resisting aluminum alloys can be obtained by adding at least one of iron and copper to high Ni- high Si aluminum alloys, and have been studying about these alloys. Further, the present inventors have researched on the assumption that alloy powder including boron as a simple substance beyond the solubility limit may be obtained by setting the dissolving temperature high and dissolving a large amount of boron in the alloy, and then rapidly cooling the alloy by a rapid solidifying (atomizing) method. As a result, the inventors have found that an aluminum alloy produced by dispersing particles of nitride and/or boride in an aluminum alloy matrix of a certain composition has a superior tensile strength and elogation at elevated temperatures, a high forgeability, and a high abrasion resistance.

The high heat resisting and high abrasion resisting aluminum alloy according to the present invention characteristically comprises 2 to 15% by weight of nickel, 0.2 to 15% by weight of silicon, 0.6 to 8.0% of iron, one or two selected from the group consisting of 0.6 to 5.0% by weight of copper and 0.5 to 3% by weight of magnesium, the total amount of the copper and the magnesium being equal to or less than 6% by weight, one or two selected from the group consisting of 0.3 to 3% by weight of zirconium and 0.3 to 3% by weight of molybdenum, the total amount of the zirconium and the molybdenum being equal to or less than 4% by weight, 0.05 to 10% by weight of boron, and the balance of aluminum and unavoidable impurities, and is produced by powder metallurgy.

This aluminum alloy can contain 0.5 to 4.0% by weight (hereinafter % means % by weight unless otherwise specified) of titanium.

Further, this aluminum alloy can be used as a matrix, and particles of at least one kind of nitrides and borides can be dispersed in the matrix by 0.5 to 10% of the total matrix. This matrix does not necessarily include boron.

This heat resisting and high abrasion resisting aluminum alloy can be provided as powder. The aluminum alloy powder is produced by dissolving the aluminum alloy of a certain composition into molten metal and then rapidly cooling the molten metal by an atomizing method.

This aluminum alloy powder can also contain 0.5 to 4.0% of titanium.

The aluminum alloy of the present invention can be provided as a bulk, too. The aluminum alloy as a bulk can be produced, for example, by the following method. The aluminum alloy of the above composition is melt and atomized into fine powder. The fine powder thus produced is molded under pressure and sintered by powder metallurgy. Otherwise, the fine powder is packed in a case, and subjected to cold isostatic pressing (CIP) and hot extruding. In the case of adding nitrides and borides to the aluminum alloy, the particles of nitrides and borides are added to the above fine powder, and the mixed powder is molded under pressure and sintered by powder metallurgy.

The mixing ratios and functions of elements other than aluminum of the heat resisting aluminum alloy according to the present invention are described hereinafter. The percentages are expressed when the matrix is taken as 100%, except that the percentage of nitride and boride is expressed when the whole composite material including the matrix is taken as 100%.

[Ni: 2 to 15%]

Nickel makes intermetallic compounds such as $NiAl_3$ together with aluminum. These intermetallic compounds are stable even at elevated temperatures and contribute to the abrasion resistance and high temperature strength of the alloy. Particularly, the intermetallic compound $NiAl_3$ has a lower hardness and a superior toughness.

Therefore, 2% or more of nickel must be added as a hardening agent of the aluminum alloy matrix so as to attain high temperature strength. It is not preferable to add more than 15% of nickel, because precipitation of coarse crystals causes a poor processability, low elongation, and low forgeability although the high temperature strength of the aluminum alloy matrix can be secured.

[Si: 0.2 to 15%]

As shown by the A390 alloy, it is known that alloys produced by dispersing fine silicon in an aluminum matrix have a superior high temperature strength and abrasion resistance.

In producing an aluminum alloy by a rapid solidifying powder metallurgy method, it is not preferable to add more than 15% of silicon because coarse primary silicon crystals generate.

The silicon content of less than 0.2% is not preferable because no effect of adding silicon is observed. The above aluminum alloy becomes brittle due to the large primary silicon crystals.

[Fe: 0.6 to 8.0%]

In general, it is believed that the addition of iron is not favorable, and the iron content of not more than 0.5% is desirable. The experiments by the present inventors, however, have showed that iron improves the strength of the obtained aluminum alloy matrix at room temperature and at a high temperature of 300° C. The iron content of less than 0.6% cannot exhibit an effect of increasing the strength of the aluminum alloy matrix at room temperature and at a high temperature of 300° C. On the other hand, the iron content of more than 8% embrittles the aluminum alloy matrix.

[Cu: 0.6 to 5.0%]

Copper allows age hardening of the heat resisting aluminum alloy, and strengthens the aluminum alloy matrix. The copper content of 0.6% or more exhibits an effect of increasing the room temperature strength of the aluminum alloy matrix. The copper content of more than 5% decreases the high temperature strength of the aluminum alloy matrix, because coarse crystals generate. As long as the aluminum alloy contains at least one of copper and magnesium by 6% or less in total, the aluminum alloy matrix can attain a superior forgeability.

[Mg: 0.5 to 3.0%]

In general, magnesium as well as copper is known as an element which strengthens an aluminum alloy. It is not preferable to add more than 3% of magnesium, because coarse chemical compounds precipitate and the forgeability decreases. However, as long as the aluminum alloy contains at least one of copper and magnesium by 6% or less in total, the aluminum alloy can attain the adding effect.

[Zr: 0.3 to 3.0%]

Zirconium is known as an additional element for improving the high temperature strength and creep resistance. Namely, when 0.3 to 3.0% of zirconium is added to the aluminum alloy matrix of the present invention, the toughness of the aluminum alloy matrix is effectively improved. The zirconium content of less than 0.3% cannot exhibit an effect of improving toughness. It is not preferable to add more than 0.3% of zirconium, because a coarse intermetallic compound ($ZrAl_3$) precipitates.

[Mo: 0.3 to 3.0%]

Molybdenum as well as zirconium is an element which improves heat resistance by the same additional amount. In the present invention, by adding at least one of zirconium and molybdenum by 4% or less in total, the forgeability and creep resistance can be secured. The addition of at least one of zirconium and molybdenum is sufficient, and the total amount of zirconium and molybdenum must be 4% or less. It is not preferable to add zirconium and molybdenum by more than 4% in total, because the forgeability decreases.

[Ti: 0.5 to 4.0%]

Titanium as well as zirconium is known as an additional element which improves high temperature strength. The inventors of the present invention have found that titanium increases the yield strength of the aluminum alloy matrix at 300° C. The titanium content must be in a range from 0.5 to 4.0%. The titanium content of less than 0.5% cannot exhibit an effect of increasing yield strength at elevated temperatures. On the other hand, the titanium content of more than 4.0% decreases the toughness of the aluminum alloy matrix.

[B as a simple substance: 0.05 to 10.0% in an alloy, 0.05 to 2% in powder]

As the amount of boron as a simple substance is larger, the sliding characteristics of the aluminum alloy matrix improve. However, when the boron content is less than 0.05%, no improvement in sliding characteristics is observed.

In rapid solidification, alloy powder including boron beyond the solubility limit can be obtained by setting the dissolving temperature high and dissolving a large amount of boron, and then rapidly cooling the alloy. However, when the aluminum alloy contains other elements such as zirconium together with boron, boron tends to become borides even in the case of producing alloy powder by rapid solidification. Whether boron exists as a simple substance or not can be confirmed, for example, by a transmission type electron microscope (TEM).

Boron dissolvable in molten aluminum is 0.22% at 730° C., and 1.7% at 1100° C. Since molten aluminum at 1100° C. or more is required to produce the aluminum alloy powder of the present invention by rapid solidification, boron contained in the powder is 2% or less in practical use. The aluminum alloy powder thus obtained is made into an alloy by sintering.

In the case of producing an aluminum alloy by adding boron powder to aluminum alloy powder afterward and then extruding, there is no restriction of the dissolving temperature, and accordingly a large amount of boron can be added. However, the addition of more than 10% of boron powder to the alloy decreases the strength and toughness of the alloy. Therefore, the boron content of the alloy must be 10% or less.

Preferably, the particle diameter of boron powder is 10 microns or less in view of the Fretting resistance and property of attaching mating materials.

In the case of adding boron by the mixing method, the average particle diameter of boron is preferably 10 microns or less in view of the property of attaching mating materials. Further, because the particle diameter of less than 0.5 micron causes segregation in mixing, the particle diameter of 0.5 micron or more is preferable.

[Nitride and boride: 0.5 to 10% in total]

The abrasion resistance of the heat resisting aluminum alloy is improved by dispersing particles of nitride and/or boride in the heat resisting aluminum alloy matrix. The nitride and boride content of less than 0.5% cannot exhibit an effect of improving abrasion resistance. It is not preferable to add nitride and boride by more than 10% in total, because the tensile strength, elongation, and processability of the aluminum alloy are remarkably decreased.

Nitride is, for example, AlN, TiN, ZrN, BN and so on. Boride is, for example, $TiB_2$, NiB, $MgB_2$, and so on.

The particle diameter of nitride and boride is preferably as ultrafine as 0.5 to 20 microns. The particle diameter of less than 0.5 micron is not preferable, because the powder coheres and the mechanical strength is lowered. When the particle diameter is more than 20 microns, the effect of improving abrasion resistance is decreased because the particles often crack and peel off in sliding. It is more preferable that the particle diameter is 10 microns or less in view of the property of attaching mating materials.

At least one kind of nitrides and borides is mixed to the heat resisting aluminum alloy of the above composition and treated by powder metallurgy, thereby producing the aluminum alloy of the present invention.

The aluminum alloy and aluminum alloy powder of the present invention have the following advantages. Because the matrix is an aluminum alloy including certain amounts of nickel, silicon, iron, copper and magnesium, and zirconium and molybdenum, the aluminum alloy and alloy powder of the present invention have a light weight. At the same time, because particles of nitride and/or boride are dispersed in the matrix, the aluminum alloy and aluminum powder of the present invention have superior abrasion resistance. Further, the aluminum alloy and aluminum alloy powder of the present invention have similar strength to that of the aluminum alloy having the matrix in which particles of nitride or boride are not dispersed.

Therefore, the use of the aluminum alloy and alloy powder of the present invention can contribute to weight reduction of, for example, automobile engine parts, such as valve spring retainers, intake valves, conrods, and pistons. Further, because the aluminum matrix composite material exhibits stable abrasion resistance, toughness, forgeability, rigidity, thermal expansion characteristics, and strength at room temperature and elevated temperatures, an engine produced from the aluminum matrix composite material of the present-invention can respond to the recent demand for high power and have low fuel consumption owing to the light weight.

DETAILED DESCRIPTION OF THE PREFERRED EMBODIMENTS

Figure 1:
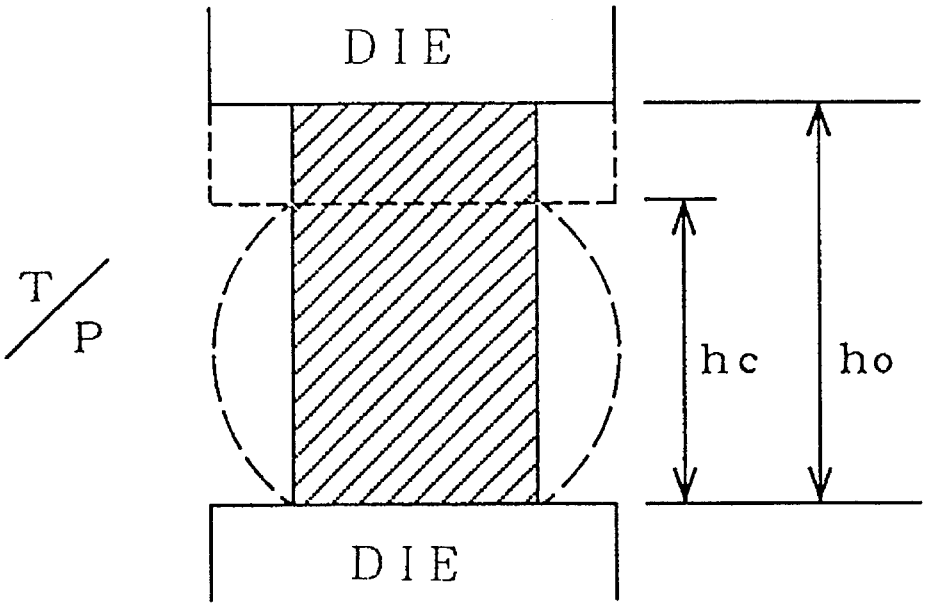
FIG. 1 is a cross sectional diagram illustrating a method of measuring limit swaging ratios of examples of the present invention and comparative examples in Evaluation 2.

Hereinafter, the present invention will be further described along with examples of the present invention and comparative examples. Tables 1 and 2 show the composition of the examples and comparative examples, and Tables 3 and 4 show characteristic values of the examples and the comparative examples.

In Tables 1 and 2, the numerals before the elements in the column of MATRIX COMPOSITION are percentages of the respective elements when the matrix is taken as 100%. The numeral before each nitride or boride in the column of ADDITIVE is a percentage of the nitride or boride when the whole aluminum alloy is taken as 100%.

The molten metal of the aluminum alloy matrices of the composition shown in Table 1 were pulverized by an atomizing method, and sieved with a 100-mesh screen.

TABLE 1

| | No | Matrix Composition | Additive |
|---|---|---|---|
| Example | 1 | Al—3Ni—0.5Si—5Fe—3Cu—1.4Mg—0.7Zr—1Mo—0.5B | — |
| | 2 | Al—11.5Ni—8Si—1.5Fe—1Cu—0.2Mg—1Zr—1Mo—1Ti—1B | — |
| | 3 | Al—11.5Ni—8Si—1.5Fe—1Cu—0.2Mg—1Zr—1Mo—1Ti—1B | 3AlN |
| | 4 | Al—11.5Ni—8Si—1.5Fe—1Cu—0.2Mg—1Zr—1Mo—0.5B | 3AlN |
| | 5 | Al—11.5Ni—8Si—1.5Fe—1Cu—0.2Mg—1Zr—1Mo—0.5B | $3TiB_2$ |
| | 6 | Al—11.5Ni—8Si—1.5Fe—1Cu—0.2Mg—1Zr—1Mo—2B | — |
| | 7 | Al—11.5Ni—8Si—1.5Fe—1Cu—0.2Mg—1Zr—1Mo—5B | — |
| | 8 | Al—3Ni—0.5Si—5Fe—3Cu—1.4Mg—0.7Zr—1Mo—0.5B | 3AlN |

Example Nos. 1 to 5 and 8 were respectively formed by dissolving predetermined amounts of boron in molten metal. In Example Nos. 3 to 5 and 8, predetermined amounts of ultrafine powder of nitride or boride having a particle diameter of 1 to 20 microns were respectively mixed with the above aluminum alloy matrix powder to produce mixed powder.

In Example Nos. 6 and 7, predetermined amounts of boron powder having a particle diameter of 5 microns were respectively mixed with the aluminum alloy matrix powder to produce alloy powder.

Each powder was packed in a bottomed tube formed of pure aluminum and cold preformed in a vacuum under a surface pressure of 3 ton/cm$^2$, thereby producing a preform of 30 mm in diameter and 80 mm in length. These preforms were heated at 450° C. for 30 minutes, and hot extruded at a relatively large extruding ratio of 10, thereby producing 8 kinds of aluminum alloys of Example Nos. 1 to 8 shown in Table 1 and having a cylindrical shape of 10 mm in diameter. Besides, the aluminum alloy powder was packed in a mold and hot pressed at 450° C. in a vacuum under a surface pressure of 3 ton/cm$^2$ and an aluminum alloy of 40×40 mm for a sliding test was cut out from the obtained molding. In all of the respective aluminum alloys of the examples of the present invention, boron was dissolved in the heat resisting aluminum alloy matrices, and in Example Nos. 3 to 5 and 8, nitride or boride was uniformly dispersed.

Comparative Example No. 51 shown in Table 2 was powder produced by pulverizing molten metal of the aluminum alloy matrix composition of Example No. 1 including no boron by an atomizing method. Comparative Example No. 52 was powder produced by pulverizing molten metal of the aluminum alloy matrix composition of Example No. 2 including no boron by an atomizing method. Comparative Example No. 53 was powder produced by pulverizing molten metal of the aluminum alloy matrix composition of Example Nos. 4 to 7 including no boron, nitride or boride by an atomizing method. Comparative Example No. 54 was produced by pulverizing molten metal of the aluminum alloy matrix of an Al-Si-Cu-Mg composition by an atomizing method and adding 15% of silicon carbide whisker to the powder. Comparative Example No. 55 was produced by pulverizing molten metal of the aluminum alloy matrix of an Al-Cu-Mg-Mn composition by an atomizing method and adding silicon carbide ultrafine powder of 2.6 microns in particle diameter to the powder by 20%. Comparative Example No. 56 was produced by pulverizing molten metal of the aluminum alloy matrix of an Al-Si-Cu-Mg composition by an atomizing method and adding silicon carbide ultrafine powder of 2.6 microns in particle diameter to the power by 20%. Comparative Example No. 57 was produced by pulverizing molten metal of the aluminum alloy matrix of an Al-Ni-Si-Cu composition by an atomizing method and adding aluminum nitride of 7.3 microns in particle diameter to the powder.

Each powder was packed into a bottomed tube formed of pure aluminum and cold preformed in a vacuum under a surface pressure of 3 ton/cm$^2$, thereby producing a preform of 30 mm in diameter and 80 mm in length. These preforms were heated at 450° C. for 30 minutes, and hot extruded at a relatively large ratio of 10, thereby producing 7 kinds of aluminum alloys of Comparative Example Nos. 51to 57 shown in Table 2 and having a cylindrical shape of 10 mm in diameter.

(TABLE 2)

[Evaluation 1]

The test specimens of the aluminum alloys of Example Nos. 1 to 8 were examined about tensile strength and elongation at room temperature, and tensile strength, yield strength and elongation at 150° C. and 300° C. The results are shown in Table 3.

As shown in Table 3, the aluminum alloys of Example Nos. 1 to 8 respectively had tensile strength sigma of more than 500 MPa at room temperature and more than 450 MPa at 150° C. The aluminum alloys of Example Nos. 1 to 8 had tensile strength or more at 300° C. except Example No. 7 (because the boron amount was large), and elongation delta of more than 4% at 300° C. The experiment showed that the test specimens of the examples of the present invention respectively had improved heat resisting strength.

(TABLE 3)

As shown in Table 4, the test specimens of Comparative Example Nos. 51 to 57 were examined about tensile strength and elongation at room temperature, and tensile strength, yield strength and elongation at 150° C. and 300° C., in the same way as the examples of the present invention.

TABLE 2

| | No | Matrix Composition | Additive |
|---|---|---|---|
| Comparative Example | 51 | Al—3Ni—0.5Si—5Fe—3Cu—1.4Mg—0.7Zr—1Mo | — |
| | 52 | Al—11.5Ni—8Si—1.5Fe—1Cu—0.2Mg—1Zr—1Mo—1Ti | — |
| | 53 | Al—11.5Ni—8Si—1.5Fe—1Cu—0.2Mg—1Zr—1Mo | — |
| | 54 | Al—0.6Si—0.3Cu—1.1Mg | $15SiC_w$* |
| | 55 | Al—4.5Cu—1.6Mg—0.5Mn | $20SiC_p$* |
| | 56 | Al—0.6Si—0.3Cu—1.0Mg | $20SiC_p$* |
| | 57 | Al—10Ni—25Si—3Cu | 3AlN |

*$SiC_w$ shows silicon carbide whiskers
$SiC_p$ shows silicon carbide ultrafine powder

TABLE 3

| | | Room Temperature | | 150° C. | | 300° C. | | | Al Adhering Area | Specific Abrasion Loss |
|---|---|---|---|---|---|---|---|---|---|---|
| | No | σ | δ | σ | δ | σ | YP | δ | Ratio (%) | ($mm^3$/kg · mm) |
| Example | 1 | 623 | 1.8 | 510 | 5.0 | 183 | 160 | 5.4 | 25 | $7.8 \times 10^{-8}$ |
| | 2 | 515 | — | 483 | 1.3 | 228 | 188 | 4.6 | 10 | $3.0 \times 10^{-8}$ |
| | 3 | 500 | — | 471 | 1.0 | 219 | 184 | 4.3 | 0 | $3.0 \times 10^{-9}$ |
| | 4 | 578 | — | 463 | 1.9 | 181 | 146 | 5.1 | 5 | $6 \times 10^{-9}$ |
| | 5 | 589 | — | 467 | 1.7 | 182 | 140 | 5.3 | 5 | $8 \times 10^{-9}$ |
| | 6 | 603 | — | 472 | 2.0 | 193 | 144 | 5.3 | 5 | $3.8 \times 10^{-8}$ |
| | 7 | 576 | — | 450 | 1.4 | 168 | 123 | 4.7 | 0 | $2.3 \times 10^{-8}$ |
| | 8 | 603 | — | 486 | 4.1 | 168 | 156 | 5.1 | 10 | $1.0 \times 10^{-8}$ |

σ: tensile strength (MPa)
YP: yield strength (MPa)
δ: elongation (%)

TABLE 4

| | | Room Temperature | | 150° C. | | 300° C. | | | Al Adhering Area | Specific Abrasion Loss |
|---|---|---|---|---|---|---|---|---|---|---|
| | No | σ | δ | σ | δ | σ | YP | δ | Ratio (%) | ($mm^3$/kg · mm) |
| Comparative Example | 51 | 641 | 1.8 | 538 | 5.3 | 183 | 157 | 5.3 | 90 | $4.1 \times 10^{-7}$ |
| | 52 | 549 | — | 490 | 1.3 | 224 | 181 | 4.8 | 55 | — |
| | 53 | 619 | — | 480 | 2.1 | 195 | 147 | 6.0 | 60 | — |
| | 54 | 385 | 2.5 | 330 | 3.8 | 153 | 129 | 8.0 | 50 | — |
| | 55 | 450 | — | 320 | — | 105 | — | — | — | $1.9 \times 19^{-7}$ |
| | 56 | 526 | — | 286 | — | 88 | — | — | — | $2.0 \times 10^{-7}$ |
| | 57 | 486 | — | 430 | — | 288 | 283 | 0.2 | — | — |

σ: tensile strength (MPa)
YP: yield strength (MPa)
δ: elongation (%)

Comparative Example Nos. 51 to 53 had the same aluminum alloy matrix composition as Example Nos. 1, 2, and 6 except no boron inclusion, and had tensile strength sigma of more than 500 MPa at room temperature, and more than 450 MPa at 150° C., and strength on the same level as those of Example Nos. 1, 2, and 6 at 300° C. It can be said that addition of boron as a single substance caused no remarkable bad influence on strength.

Example Nos. 1 to 8 exhibited superior heat resisting strength as shown by the tensile strength of more than 450 MPa at 150° C. This was because the composition of the aluminum alloy matrices was appropriate as apparent from the comparision with Comparative Example Nos. 51 to 53. Further, Example Nos. 1 to 8 exhibited superior high temperature strength as shown by the tensile strength of more than 150 MPa at 300 ° C., because the composition of the aluminum alloy matrices was appropriate. On the other hand, Comparative Example No. 54 had a high tensile strength of 153 MPa at 300° C. because the silicon carbide whiskers were added by 15%. Due to the large amount of silicon carbide whiskers, however, Comparative Example No. 54 had such a low forgeability and processability that it could not be put in practical use. Comparative Example No. 57 had a high tensile strength of 283 MPa at 300 ° C., but such a remarkably low elongation of 0.2% that Comparative Example No. 57 could not be practically used. On the other hand, having elongation of more than 4% at 300° C., the examples of the present invention had a good balance of tensile strength and elongation.

Example Nos. 2 and 3 and Comparative Example No. 52 respectively had superior yield strength of more than 180 MPa at 300 ° C. This was assumed to be because they contained 1% of titanium, and that was apparent from the comparison with the yield strength of Comparative Example No. 53. On the other hand, Comparative Example No. 57 also had a high yield strength at 300° C., but due to the large silicon content the elongation was as low as 0.2% and the forgeability and processability was low, so that Comparative Example No. 57 could not be put into practical use.

Example Nos. 1 to 8 had superior specific abrasion losses on the orders of $10^{-8}$, and $10^{-9}$. Particularly the examples to which not only boron but also nitride or boride as hard particles were added had excellent specific abrasion losses.

Comparative Example No. 51 had a large specific abrasion loss on the order of $10^{-7}$ due to no boron inclusion. Comparative Example Nos. 55 and 56 had large specific abrasion losses because a large amount of silicon carbide powder was added.

[Evaluation 2]

The Fretting resistance was evaluated by beating the aluminum alloys for the sliding test repeatedly with a flat plate formed of steel (nitrified JIS430 stainless steel) at 100° C. under a surface pressure of 1.2 MPa at a speed of 5 Hz for ten minutes, and observing an adhering area ratio (%) of each aluminum alloy for the sliding test.

Example Nos. 1 to 8 respectively had superior Fretting resistance as shown by not more than 25% of the aluminum adhering area. Particularly, the examples to which not only boron but also nitride or boride were added, and the examples to which a large amount of boron was added exhibited superior Fretting resistance.

On the other hand, Comparative Example Nos. 51 to 54 including no boron respectively had low Fretting resistance as shown by 50% or more of the aluminum adhering area. It is apparent that addition of boron was effective.

Production of an aluminum alloy having a good balance of strength, heat resistance, forgeability, abrasion resistance and Fretting resistance requires to add boron as a simple substance to the matrix and to specify nitrides and borides.

It is apparent from the above evaluation that the alloy powder and alloys produced from molten metal of the aluminum alloy matrices of the composition of Example Nos. 1 to 8 had light weight and superior abrasion resistance, forgeability, and tensile strength at room temperature and elevated temperatures.

Next, examples of the present invention and comparative examples including no boron in the matrices will be described. Tables 5 and 6 show the composition of the examples and the comparative examples, and Tables 7 and 8 show characteristic values of the examples and the comparative examples.

In Tables 5 and 6, the numerals before the elements in the column of MATRIX COMPOSITION show percentages of the respective elements when the matrix is taken as 100%. The numeral before each nitride or boride in the columns of NITRIDE and BORIDE is a percentage of the nitride or boride when the whole composite material is taken as 100%.

Molten metal of the aluminum matrices of the composition shown in Table 5 were pulverized by an atomizing method, and sieved with a 100-mesh screen. Then, a predetermined amount of nitride or boride of 1 to 20 microns in particle diameter was mixed with the above matrix powder.

Each mixed powder was packed in a bottomed tube formed of pure aluminum and cold preformed in a vacuum under a surface pressure of 3 ton/cm$^2$, thereby producing a preform of 30 mm in diameter and 80 mm in length. The preforms were heated at 450° C. for thirty minutes, and hot extruded at a relatively large extruding ratio of 10, thereby producing 9 kinds of aluminum matrix composite materials of Example Nos. 9 to 17 shown in Table 5 and having a cylindrical shape of 10 mm in diameter. In these aluminum matrix composite materials of the examples, particles of nitride or boride were dispersed in the heat resisting aluminum alloy matrix.

TABLE 5

| | No | Matrix Composition | Nitride | Boride |
|---|---|---|---|---|
| Example | 9 | Al—3Ni—8Si—5Fe—2.8CU—1.3Mg—0.7Zr—1Mo | 3AlN | — |
| | 10 | Al—3Ni—8Si—5Fe—2.8Cu—1.3Mg—0.7Zr—1Mo | 3ZrN | — |
| | 11 | Al—3Ni—8Si—5Fe—2.8Cu—1.3Mg—0.7Zr—1Mo | 3TiN | — |
| | 12 | Al—3Ni—8Si—5Fe—2.8Cu—1.3Mg—0.7Zr—1Mo | — | 3NiB |
| | 13 | Al—3Ni—8Si—5Fe—2.8Cu—1.3Mg—0.7Zr—1Mo | — | $3TiB_2$ |
| | 14 | Al—3Ni—8Si—5Fe—2.8Cu—1.3Mg—0.7Zr—1Mo | — | $3MgB_2$ |
| | 15 | Al—3Ni—0.5Si—5Fe—3Cu—1.4Mg—0.7Zr—1Mo | 3AlN | — |
| | 16 | Al—11.5Ni—8Si—1.5Fe—1Cu—0.2Mg—1Zr—1Mo—1Ti | 3AlN | — |
| | 17 | Al—11Ni—8Si—1.5Fe—1Cu—0.2Mg—1Zr—1Mo | 3AlN | — |

Comparative Example Nos. 58, 59, 64, and 65 were produced by pulverizing molten metal of the aluminum alloys of the composition shown in Table 6 by an atomizing method, and sieving the powder with a 100-mesh screen, thereby producing aluminum alloy powder. Comparative Example Nos. 60 to 62 were produced by pulverizing molten metal of the aluminum matrices of the composition shown in Table 6 by the atomizing method, sieving the powder with a 100-mesh screen, and mixing predetermined amounts of ultrafine powder of nitride or boride of 1 to 20 microns in particle diameter with the above matrix powder. Comparative Example No. 63 was produced by pulverizing molten metal of the aluminum matrix of the composition shown in Table 6 by the atomizing method, sieving the powder with a 100-mesh screen, and mixing silicon carbide ultrafine powder of 2.6 microns in particle diameter with the matrix powder by 15%.

Each powder was packed into a bottomed tube formed of pure aluminum and cold preformed in a vacuum under a surface pressure of 3 ton/cm$^2$, thereby producing a preform of 30 mm in diameter and 80 mm in length. These preforms were heated at 450° C. for thirty minutes and hot extruded at a relatively large extruding ratio of 10, thereby producing 8 kinds of aluminum matrix composite materials and aluminum alloys of Comparative Example Nos. 58 to 65 shown in Table 6 and having a cylindrical shape of 10 mm in diameter.

TABLE 6

| | No | Matrix Composition | Nitride | Boride |
|---|---|---|---|---|
| Comparative Example | 58 | Al—3Ni—8Si—5Fe—2.8CU—1.3Mg—0.7Zr—1Mo | — | — |
| | 59 | Al—3Ni—0.5Si—5Fe—3Cu—1.4Mg—0.7Zr—1Mo | — | — |
| | 60 | Al—15Ni—20Si | 3TiN | — |
| | 61 | Al—15Ni—20Si | — | $3TiB_2$ |
| | 62 | Al—10Ni—25Si—3Cu | 3AlN | — |
| | 63 | Al—0.6Si—0.3Cu—1.1Mg + 15SiC | — | — |
| | 64 | Al—11.5Ni—8Si—1.5Fe—1Cu—0.2Mg—1Zr—1Mo—1Ti | — | — |
| | 65 | Al—11Ni—8Si—1.5Fe—1Cu—0.2Mg—1Zr—1Mo | — | — |

TABLE 7

| | | Room Temperature | | 150° C. | | 300° C. | | | Limit Swaging Ratio at | Specific Abrasion Loss |
|---|---|---|---|---|---|---|---|---|---|---|
| | No | σ | δ | σ | δ | σ | YP | δ | 450° C. (%) | ($mm^3$/kg · mm) |
| Example | 9 | 562 | 0.8 | 468 | 3.1 | | | | 80 | $1.5 \times 10^{-8}$ |
| | 10 | 578 | 0.8 | 455 | 3.0 | | | | 73 | $1.3 \times 10^{-7}$ |
| | 11 | 553 | 1.0 | 460 | 3.3 | | | | 75 | $1.3 \times 10^{-7}$ |
| | 12 | 580 | 0.4 | 466 | 2.8 | | | | 76 | $5 \times 10^{-8}$ |
| | 13 | 547 | 0.9 | 453 | 2.9 | | | | 70 | $1.2 \times 10^{-7}$ |
| | 14 | 570 | 0.9 | 463 | 3.2 | | | | 75 | $5 \times 10^{-8}$ |
| | 15 | 565 | — | 481 | 3.5 | | | | 73 | $1.8 \times 10^{-8}$ |
| | 16 | 520 | — | 472 | 1.0 | 221 | 165 | 4.0 | 64 | $1.8 \times 10^{-8}$ |
| | 17 | 572 | — | 465 | 1.3 | 185 | 130 | 4.7 | 62 | $3.1 \times 10^{-8}$ |

σ: tensile strength (MPa)
YP: yield strength (MPa)
δ: elongation (%)
—: approximately zero, unmeasurable
blank: not measured

TABLE 8

| | | Room Temperature | | 150° C. | | 300° C. | | | Limit Upsetting Ratio At | Specific Abrasion Loss |
|---|---|---|---|---|---|---|---|---|---|---|
| | No | σ | δ | σ | δ | σ | YP | δ | 450° C. (%) | ($mm^3$/kg · mm) |
| Comparative Example | 58 | 602 | 1.0 | 491 | 3.4 | | | | 81 | $4.0 \times 10^{-7}$ |
| | 59 | 641 | 1.8 | 538 | 5.3 | | | | 76 | $4.1 \times 10^{-7}$ |
| | 60 | 480 | — | 438 | — | 288 | 204 | 2.0 | 40.5 | $2 \times 10^{-9}$ |
| | 61 | 493 | — | 445 | — | 274 | 194 | 2.4 | 45.0 | $3 \times 10^{-9}$ |
| | 62 | 486 | — | 430 | — | 288 | 283 | 0.2 | | |
| | 63 | 385 | 2.5 | 330 | 3.8 | 153 | 129 | 8.0 | 75.2 | |
| | 64 | 549 | | 490 | 1.3 | 224 | 181 | 4.8 | | |
| | 65 | 619 | | 480 | 2.1 | 195 | 147 | 6.0 | | |

σ: tensile strength (MPa)
YP: yield strength (MPa)
δ: elongation (%)
—: approximately zero, unmeasurable
blank: not measured

[Evaluation 3]

The test specimens of the aluminum matrix composite materials of Example Nos. 9 to 17 were examined about tensile strength and elongation at room temperature, tensile strength and elongation at 150° C. The test specimens of Example Nos. 16 and 17 were additionally examined about tensile strength, yield strength and elongation at 300° C. The results are shown in Table 7.

Table 7 shows that the aluminum matrix composite materials of Example Nos. 9 to 17 respectively had tensile strength sigma of more than 500 MPa at room temperature and more than 450 MPa at 150° C. Therefore, it is apparent that the test specimens of the examples of the present invention had improved heat resisting strength.

As shown in Table 8, the test specimens of Comparative Example Nos. 58 to 65 were examined about tensile strength and elongation at room temperature and 150° C. The test specimens of Comparative Example Nos. 60 to 65 were additionally examined about tensile strength, yield strength and elongation at 300° C.

Comparative Example Nos. 58, 59, 64 and 65 had the same composition as the matrix composition of the examples of the present invention, and had tensile strength sigma of more than 500 MPa at room temperature and more than 450 MPa at 150° C. The aluminum alloy of Comparative Example No. 58 had the same composition as the matrix composition of Example No. 9. Similarly, Comparative Example Nos. 59, 64, and 65 had the same composition as the matrix composition of Example Nos. 10, 16, and 17, respectively. These comparative examples had approximately the same strength as the examples of the present invention. Accordingly, it can be said that the addition of nitride or boride gave no remarkable bad influence on the strength.

Comparative Example Nos. 60 and 61 were produced by adding nitride or boride to a matrix comprising only aluminum, nickel and silicon, and had tensile strength sigma of less than 500 MPa at room temperature and less than 450 MPa at 150° C. Comparative Example No. 62 was produced by adding nitride to a matrix including no zirconium or molybdenum, and had insufficient tensile strength sigma of less than 500 MPa at room temperature and less than 450 MPa at 150° C. Comparative Example No. 63 had low tensile strength sigma of less than 400 MPa at room temperature and 150° C., because the matrix included no nickel, no iron, little silicon (only 0.6%), and no zirconium or molybdenum.

Further, owing to the titanium content of 1%, Example No. 16 had better yield strength at 300° C. than that of Example No. 17.

In summary, matrix composition of the present invention can give desired strength to aluminum alloys.

[Evaluation 4]

Five to eight test pieces of 10 mm in diameter and 15 mm in length were cut out respectively from the aluminum matrix composite materials and aluminum alloys which had the composition shown in Tables 5 and 6 and were sintered body produced in the same way as in Evaluation 3. Then, as shown in FIG. 1, each test piece (T/P) was sandwiched between dies, and the upsetting ratio was varied at a forging speed of 70 mm/sec at 450° C. In this way, a forging test for measuring a limit upsetting ratio (%) was conducted. The results are shown in Tables 7 and 8.

The limit swaging ratio (%) was calculated by the following formula:

$$\epsilon_{hc}=(h_0-h_c)\times 100/h_0$$

All of Example Nos. 9 to 17 had superior forgeability, as shown by the limit upsetting ratios of 60% or more at 450° C. Comparative Example Nos. 58, 59, and 63 had superior forgeability, as shown by the limit upsetting ratios of 60% or more at 450° C. However, Comparative Example Nos. 60 and 61 including nitride or boride had limit upsetting ratios of 50% or less because the matrix included 15% of nickel and 20% of silicon. The limit upsetting ratios of other comparative examples were not measured. It is easily assumed that Comparative Example No. 62 had a very low limit upsetting ratio, because the matrix included 10% of nickel and 25% of silicon and the alloy had an elongation of 0.2% at 300° C. Therefore, these facts show that the forgeability cannot be improved only by mixing nitride or boride to the aluminum matrix, and that the matrix composition must be specified.

The superior forgeability of the composite materials of the present invention is attributed to choosing the nickel content, the silicon content, the iron content (the silicon content, in particular) to be not more than 15%, not more than 5%, and not more than 8%, respectively.

[Evaluation 5]

Next, an abrasion test was conducted on the aluminum matrix composite materials of Example Nos. 9 to 17 and the aluminum alloys of Comparative Example No. 58 to 65. Abrasion losses were measured by using an LFW tester, and pushing each test specimen against an oil-immersed annular mating member formed of SUJ2 under a load of 150N for 15 minutes at a sliding speed of 18 m/minute.

The results are shown in Tables 7 and 8.

As apparent from Table 7, the test specimens of Example Nos. 9 to 17 respectively had specific abrasion losses of $1.3\times10^{-7}$ $mm^3$/kg mm or less, and had a good balance of high temperature strength, forgeability, and abrasion resistance.

Comparative Example Nos. 58, 59 and 63 including no nitride or boride had good forgeability as shown by the limit swaging ratios of 75% or more at 450° C. in Table 8, but low abrasion resistance as shown by the large specific abrasion losses of about $4.0\times10^{-7}$. Due to nitride or boride inclusion, Comparative Example Nos. 60, 61 had good abrasion resistance as shown by the specific abrasion losses of $2\times10^{-9}$ and $3\times10^{-9}$, but low forgeability as shown by the low limit swaging ratios of 40.5% and 45.0%.

In summary, production of aluminum matrix composite materials having a good balance of strength, heat resistance, forgeability, and abrasion resistance requires to specify matrix composition and an amount of nitride or boride to be added.

The above evaluation shows that the aluminum matrix composite materials produced by sintering the aluminum matrix composite material powder of Example Nos. 9 to 17 had a light weight and superior abrasion resistance, forgeability, and tensile strength at room temperature and high temperatures.

Having now fully described the present invention, it will be apparent to one of ordinary skill in the art that many changes and modifications can be made thereto without departing from the spirit or scope of the present invention as set forth herein including the appended claims.

What is claimed is:

1. A high heat resisting and high abrasion resisting aluminum alloy, consisting essentially of 2 to 15% by weight of nickel (Ni), 0.2 to 15% by weight of silicon (Si), 0.6 to 8.0% of iron (Fe), one or two elements selected from the group consisting of 0.6 to 5.0% by weight of copper (Cu) and 0.5 to 3% by weight of magnesium (Mg), the total amount of said copper (Cu) and said magnesium (Mg) being equal to or less than 6% by weight, 0.3 to 3% by weight of zirconium (Zr), 0.3 to 3% by weight of molybdenum (Mo), the total amount of said zirconium (Zr) and said molybdenum (Mo) being equal to or less than 4% by weight, 0.05 to 10% by weight of boron (B), and the remainder being inevitable impurities and aluminum (Al), which alloy is produced by rapidly solidified powder metallurgy and contains dissolved boron beyond the solubility limit.

2. The high heat resisting and high abrasion resisting aluminum alloy according to claim 1, further consisting essentially of 0.5 to 4.0% by weight of titanium (Ti).

3. A high heat resisting and high abrasion resisting aluminum alloy, wherein a matrix is said high heat resisting and high abrasion resisting aluminum alloy according to claim 1, and particles of at least one selected from the group consisting of nitrides and borides dispersed in said matrix by 0.5 to 10% in the amount of weight in total, of the whole aluminum alloy including said matrix.

4. A high heat resisting and high abrasion resisting aluminum alloy powder, consisting essentially of 2 to 15% by weight of nickel (Ni), 0.2 to 15% by weight of silicon (Si), 0.6 to 8.0% by weight of iron (Fe), one or two elements selected from the group consisting of 0.6 to 5.0% by weight of copper (Cu) and 0.5 to 3% by weight of magnesium (Mg), the total amount of said copper (Cu) and said magnesium (Mg) being equal to or less than 6% by weight, 0.3 to 3% by weight of zirconium (Zr), 0.3 to 3% by weight of molybdenum (Mo), the total amount of said zirconium (Zr) and said molybdenum (Mo) being equal to or less than 4% by weight, and 0.05 to 10% by weight of boron (B), the remainder being inevitable impurities and aluminum, which alloy is produced by an atomizing method and contains dissolved boron beyond the solubility limit.

5. The high heat resisting and high abrasion resisting aluminum alloy powder according to claim 4, further consisting essentially of 0.5 to 4.0 % by weight of titanium (Ti).

* * * * *